US005934392A

United States Patent [19]

Nilsen

[11] Patent Number: 5,934,392

[45] Date of Patent: Aug. 10, 1999

[54] PRESSURE CONVERTER

[75] Inventor: Nils Inge Nilsen, Kvernaland, Norway

[73] Assignee: Den norske stats oljeselskap a.s., Stavanger, Norway

[21] Appl. No.: 08/809,726

[22] PCT Filed: Oct. 3, 1995

[86] PCT No.: PCT/NO95/00176

§ 371 Date: Apr. 8, 1997

§ 102(e) Date: Apr. 8, 1997

[87] PCT Pub. No.: WO96/12081

PCT Pub. Date: Apr. 25, 1996

[30] Foreign Application Priority Data

Oct. 12, 1994 [NO] Norway ..... 94.3855

[51] Int. Cl.[6] ..... E21B 7/18; E21B 21/00

[52] U.S. Cl. ..... 175/93; 417/225; 417/400

[58] Field of Search ..... 175/324, 93, 67; 299/17; 417/225, 400, 403

[56] References Cited

U.S. PATENT DOCUMENTS

| | | | |
|---|---|---|---|
| 4,047,581 | 9/1977 | Erickson | 175/95 |
| 5,429,036 | 7/1995 | Latos | 91/181 |
| 5,632,604 | 5/1997 | Poothodiyil | 417/225 |
| 5,787,998 | 8/1998 | O'Hanlon et al. | 175/324 X |

FOREIGN PATENT DOCUMENTS

| | | |
|---|---|---|
| 0 333 484 | 9/1989 | European Pat. Off. . |
| 0 335 543 | 10/1989 | European Pat. Off. . |
| 169088 | 5/1992 | Norway . |
| 171322 | 2/1993 | Norway . |
| 171323 | 2/1993 | Norway . |
| 171325 | 2/1993 | Norway . |
| 91/07566 | 5/1991 | WIPO . |
| 92/08871 | 5/1992 | WIPO . |
| 92/08872 | 5/1992 | WIPO . |

*Primary Examiner*—David J. Bagnell
*Attorney, Agent, or Firm*—Foley & Lardner

[57] ABSTRACT

Pressure amplifier mounted at the lower end of a drill pipe for deep drilling to generate an increased fluid pressure. A piston with a pressure stroke and a return stroke between end positions in a cylinder has a large piston area which during the pressure stroke is subjected to the drilling fluid pressure, a first opposite piston area and a second opposite and small piston area which during the pressure stroke generates an increased pressure in a smaller portion of the drilling fluid flow. A valve arrangement controls drilling fluid flows to and from the piston. For each end position of the piston there is provided at least one moveable valve control element which is adapted to be moved by the piston at either end position, in order to activate the valve arrangement.

15 Claims, 19 Drawing Sheets

PRESSURE CONVERTER

BACKGROUND OF THE INVENTION

1. Field of the Invention

This invention relates to an improved design of a pressure amplifier or converter for mounting above the drill bit at the lower end of a drill pipe for deep drilling, in particular for oil and gas, and for generating an increased fluid pressure by utilizing energy in a drilling fluid flow downwards through the drill string and the drill pipe. This may be for the purpose of obtaining an enhanced drilling effect, preferably by means of one or more high pressure jets adapted to have a cutting effect in the surrounding rock.

2. Description of the Related Art

The invention can be regarded as a further development and improvement of structures described in Norwegian Patent Specifications Nos. 169.088, 171.322, 171.323 and 171.325. Norwegian Patent 171.323 is particularly directed to a valve assembly for this type of pressure converter, which advantageously can be replaced by new and improved design to be described in the following description. This new design involve, inter alia, less wear of vital valve parts and besides better reliability and safety under the extreme conditions that the structures are subjected to in actual use.

SUMMARY OF THE INVENTION

As in the pressure converters according to the above mentioned Norwegian Patent Specifications, the present invention takes its starting point in an arrangement comprising a reciprocating piston having a pressure stroke and a return stroke between opposite end positions in a cylinder, and being at one side (low pressure side) provided with a relatively large piston area which during the pressure stroke is subjected to the drilling fluid pressure in the drill pipe, a first opposite area and a second, opposite and relatively small piston area which during the pressure stroke generates an increased pressure in a smaller portion (high pressure side) of the drilling fluid flow, valve means for controlling drilling fluid flows to and from the piston, a channel for connecting a space in front of the first, opposite piston area to the annulus outside the drill pipe at least during the pressure stroke, a second channel with a check valve, connecting said high pressure side to a high pressure channel leading forward to the drill bit, and at least one additional channel being adapted to connect the low pressure side to the annulus outside the drill pipe during the return stroke.

What is novel in the pressure converter according to the invention that for each end position of the piston, there is provided at least one moveable valve control element which is adapted to be moved by the piston at either end position, and that each valve control element is adapted to activate at least one valve body in said valve means, which is adapted to be re-positioned upon movement of the valve control element(s) concerned, for said control of drilling fluid flows during the pressure stroke and return stroke respectively.

BRIEF DESCRIPTION OF THE DRAWINGS

In the following description, the new structural solutions according to the invention as well as additional advantages and specific features thereof, will be more closely explained with reference to the drawings, wherein.

DESCRIPTION OF SPECIFIC EMBODIMENTS

Since the present pressure converter as far as the main features thereof are concerned, except for the valve arrangement, is closely related to corresponding structures according to the above mentioned Norwegian Patent Specifications, it seems to be sufficient here just to include a short discussion of these main features and functions.

Figure 1:
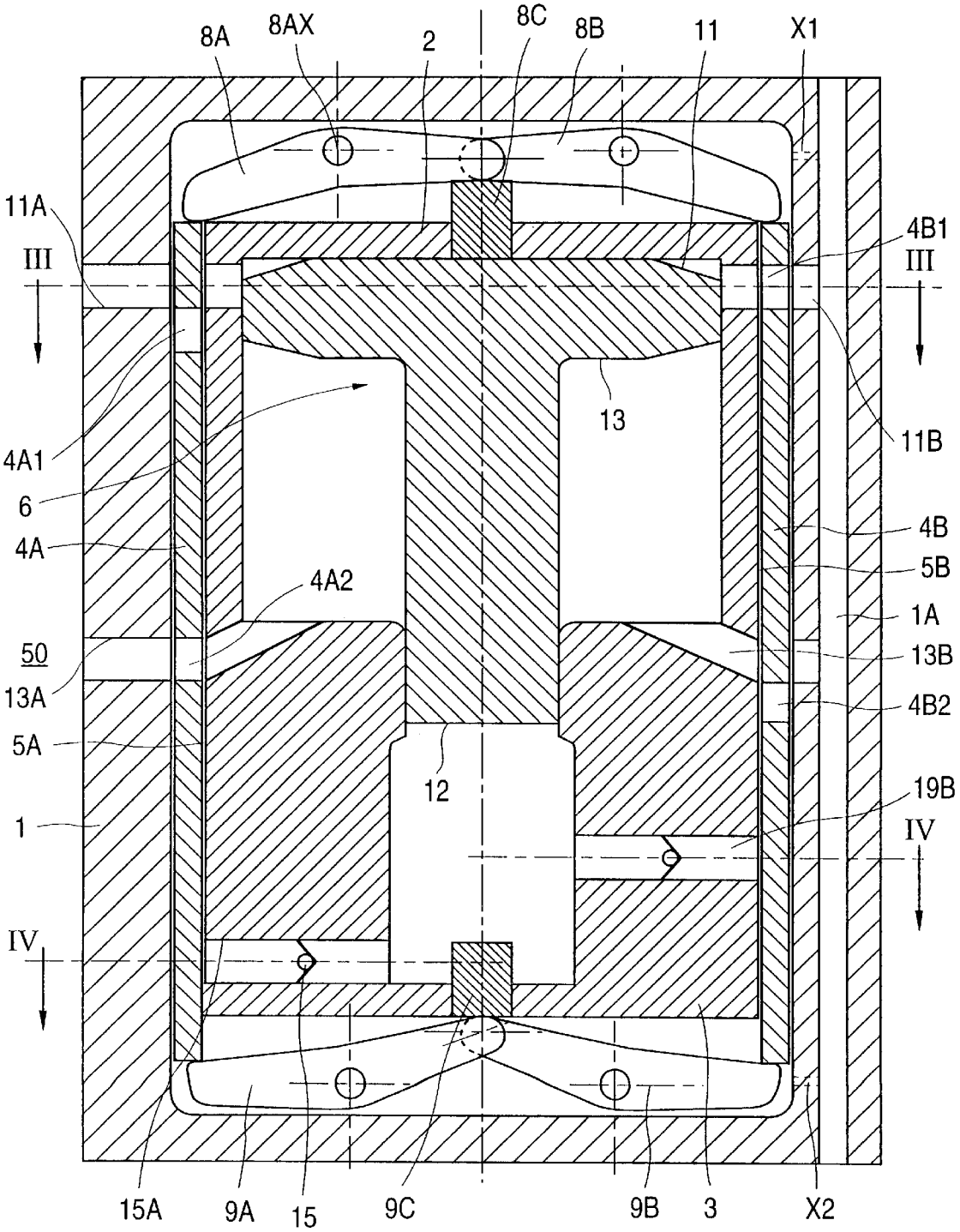
FIG. 1 in longitudinal sectional view shows a first embodiment of a pressure converter according to the invention, with the piston in an upper end position.

As in the previously proposed designs, the embodiment of FIG. 1 comprises a generally cylindrical housing 1, 2 and 3 adapted to accomodate the piston 6. This has three active piston areas, i.e. an upper relatively large piston area 11, a first opposite piston area 13 and a second opposide and relatively small piston area 12 at the lower end of piston member 6. This is adapted to be freely movable axially under the influence of varying drilling fluid pressure on the respective piston areas.

The space or volume in front of piston area 11, can be designated low pressure space, whereas the volume in front of piston area 12 correspondingly can be denoted high pressure space. This latter space is connected through a channel 15A with a check valve 15, to a header channel 16A (FIG. 4) for the resulting drilling fluid flow at an increased pressure. Channel 16A runs through the whole longitudinal direction of the housing, i.e. the cylinder wall 1, for the purpose of interconnecting several such pressure converter units into a group.

The valve arrangement according to the invention in the first embodiment shown in FIGS. 1–4, comprises two longitudinally displaceable valve bodies 4A and 4B being each provided with respective through-flow openings 4A1, 4A2 and 4B1, 4B2. These valve bodies are provided in the cylinder wall 1 and are opposite to one another. Valve bodies 4A and 4B are adapted to be moved from open to closed position of the openings 4A1, 4A2, 4B1 and 4B2 respectively. In FIG. 1 (and FIG. 3) openings 4B1 and 4A2 are opened, whereas the other two openings are closed. Various modifications of a control and actuator device for bringing about the above re-positioning movements of the valve bodies 4A and 4B, will be explained more closely below. At this point, a short discussion of the main function of the pressure converter shall be given.

Figure 2:
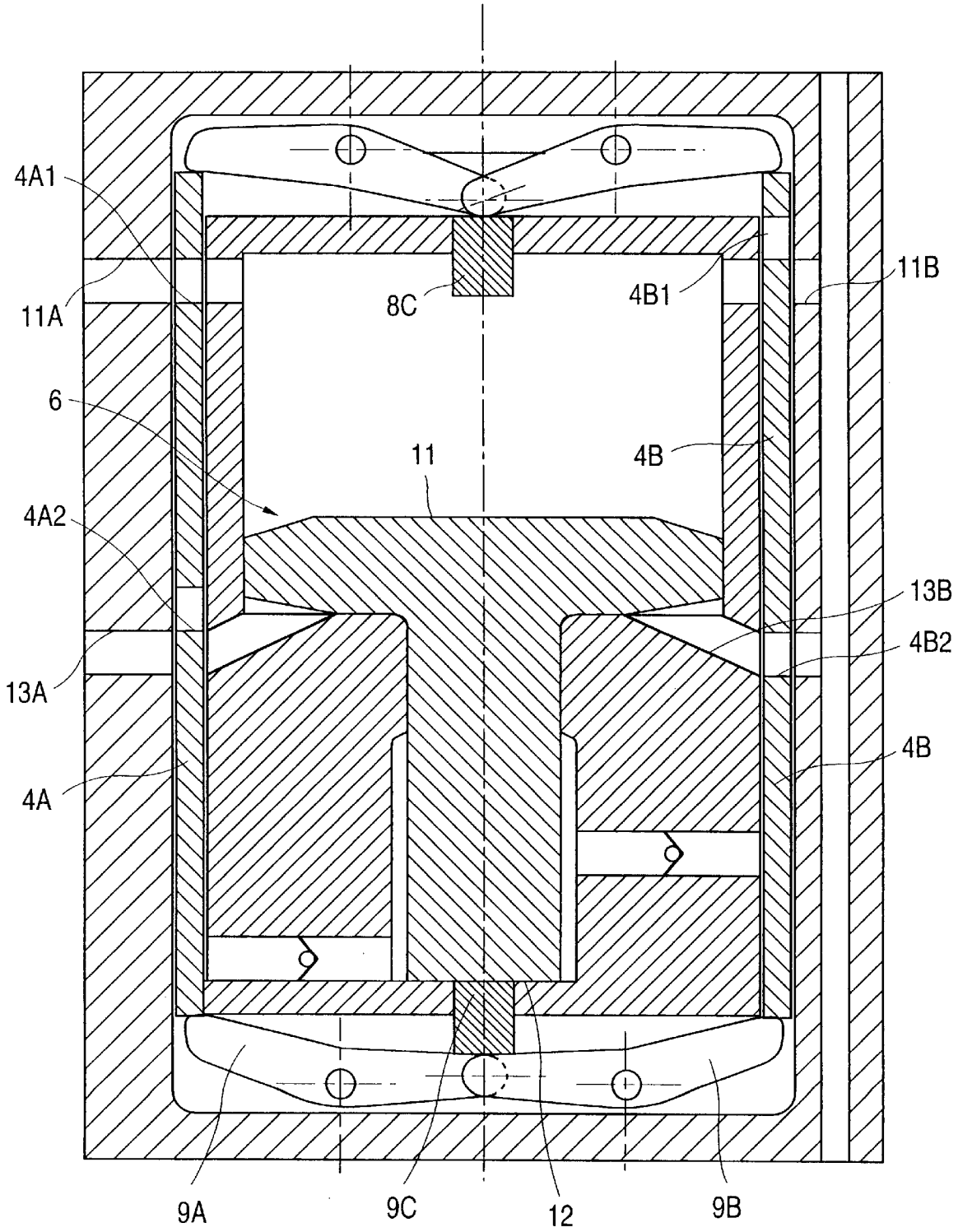
FIG. 2 shows a sectional view similar to the one in FIG. 1, but with the piston in its lower end position.

Starting from the situation in FIG. 1 where piston 6 is in the upper position and valve opening 4B1 admits drilling fluid to the upper side of the piston through the inlet channel 11B, piston 6 will be urged downwards. Fluid being present in front of piston area 13 at the underside of piston 6, thereby will flow out through channel 13A valve opening 4A2 to the annulus 50 between the drill string or the cylinder wall 1 and the casing (not shown). Thus, piston 6 will be driven downwards to its bottom position as shown in FIG. 2. In order to obtain a return stroke of the piston, the valve arrangement is reset to the position shown in FIG. 2, where valve opening 4A1 is opened for flow out to the outlet channel 11A.

FIG. 2 shows the situation when piston 6 is in its bottom position, from which a return stroke shall be initiated when valve bodies 4A and 4B have been reset to the positions shown in FIG. 2. Here drilling fluid pressure will enter through valve opening 4B2 and channel 13B so as to act upon piston area 13, whereas the space above piston area 11 is vanted through valve opening 4A1 and channel 11A to allow drilling fluid to be pressed out to annulus 50, which has a substantially lower pressure.

The above mentioned control or actuator device for re-positioning valve bodies 4A and 4B, comprises a set of valve control elements beyond either end of piston 6, as illustrated in FIG. 1 and FIG. 2. Thus, at the upper end, i.e. the low pressure side, there is shown a mechanism comprising a plug 8C being axially movable in a corresponding hole centrally in the end wall 2 of the housing, so that the inner (lower) end of the plug 8C can co-operate with piston area 11 when this is located at or near its upper end position. The opposite end of plug 8C engages inner ends of two rocker arms 8A and 8B, being pivotally mounted at a middle portion, as shown with respect to arm 8A with a pivot pin 8AX. The outer ends of rocker arms 8A and 8B are adapted to engage respective upper ends of valve bodies 4A and 4B. Thus, in the position shown in FIG. 1, piston 6 has pushed plug 8C upwards with a resulting rocking movement of both arms 8A and 8B, so that the outer ends thereof have pushed valve bodies 4A and 4B downwards to a lower position, where openings 4B1 and 4A2 of the valve bodies are positioned for initiating a downward pressure stroke of piston 6, as already explained above.

At the opposite or lower end of the cylinder housing 1 and outside the lower end wall 3 thereof, in a manner corresponding to what is found at the upper end, there is provided a transfer mechanism with elements 9C, 9A and 9B corresponding to 8C, 8A and 8B. However, in FIG. 1 the lower valve control elements are shown in a position where plug 9C projects into the high pressure space in front of piston area 12. This position is caused by valve bodies 4A and 4B, their lower ends having pushed the outer ends of rocker arms 9A and 9B downwards.

FIG. 2 shows the situation when piston 6 has performed its pressure stroke from the position in FIG. 1. Thereby both the valve arrangement and all valve control elements have been re-positioned under the influence of piston area 12 which has pushed plug 9C downwards.

A factor of significance in this connection is that plug 9C, which is subjected to the high pressure generated in the space in front of piston 12, should have a cross-sectional area being so small that is not able to move rocker arms 9A and 9B as a result of the hydraulic pressure alone.

Valve bodies 4A and 4B in FIG. 1 and FIG. 2 have a total length corresponding substantially to the length of the cylindrical housing 1, and according to the invention it is preferred that each valve body has a length dimension corresponding at least to the stroke of piston 6. Then the valve bodies can have openings, for example 4A1, 4A2 and 4B1, 4B2, which more or less directly can be set in positions for communication with the low pressure side in the upper position of the piston, and with the opposite side of the piston respectively, i.e. the space in front of piston area 13, in the lower piston position.

Figure 3:
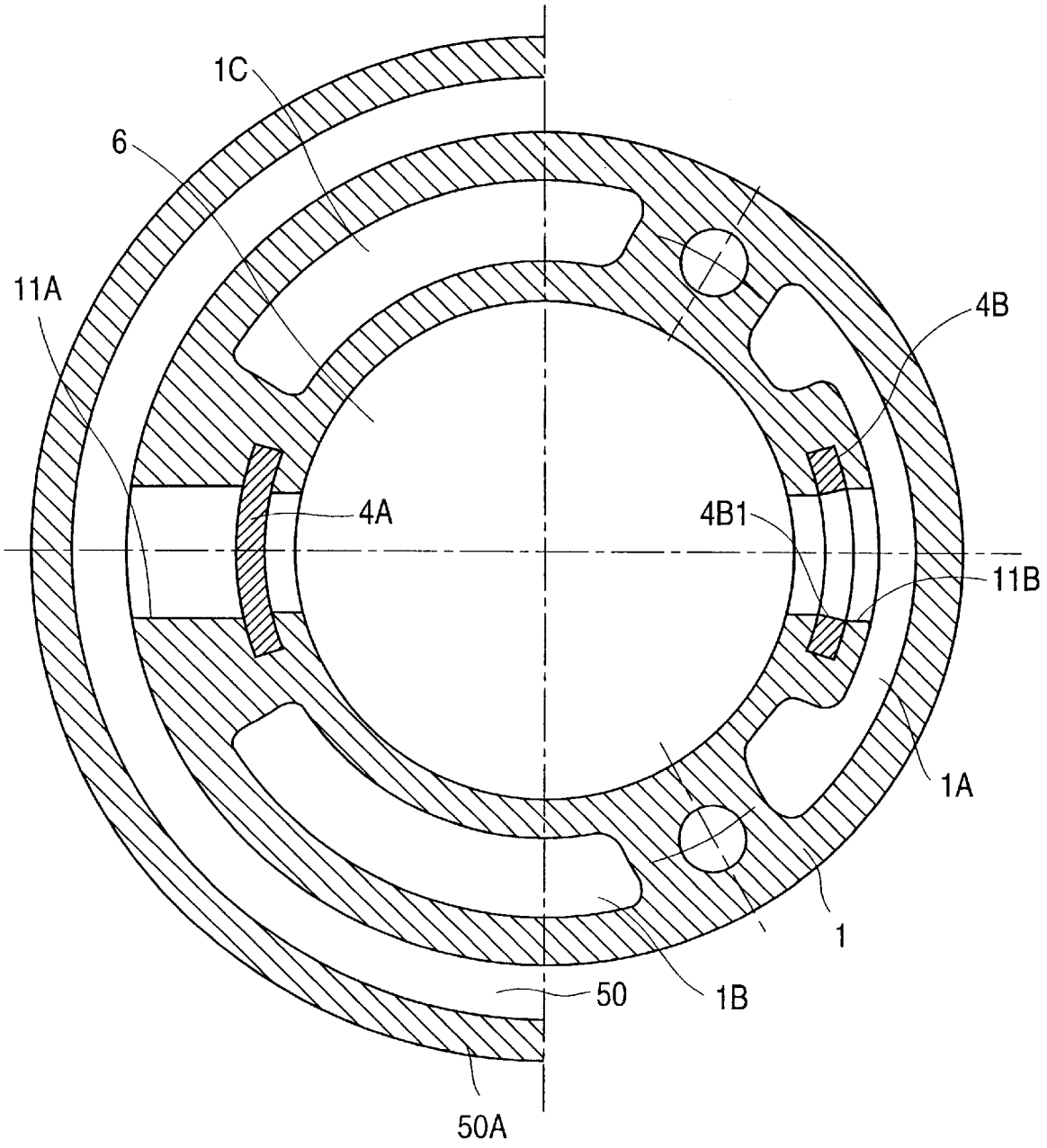
FIG. 3 shows a cross-section along lines III—III in FIG. 1.
Figure 4:
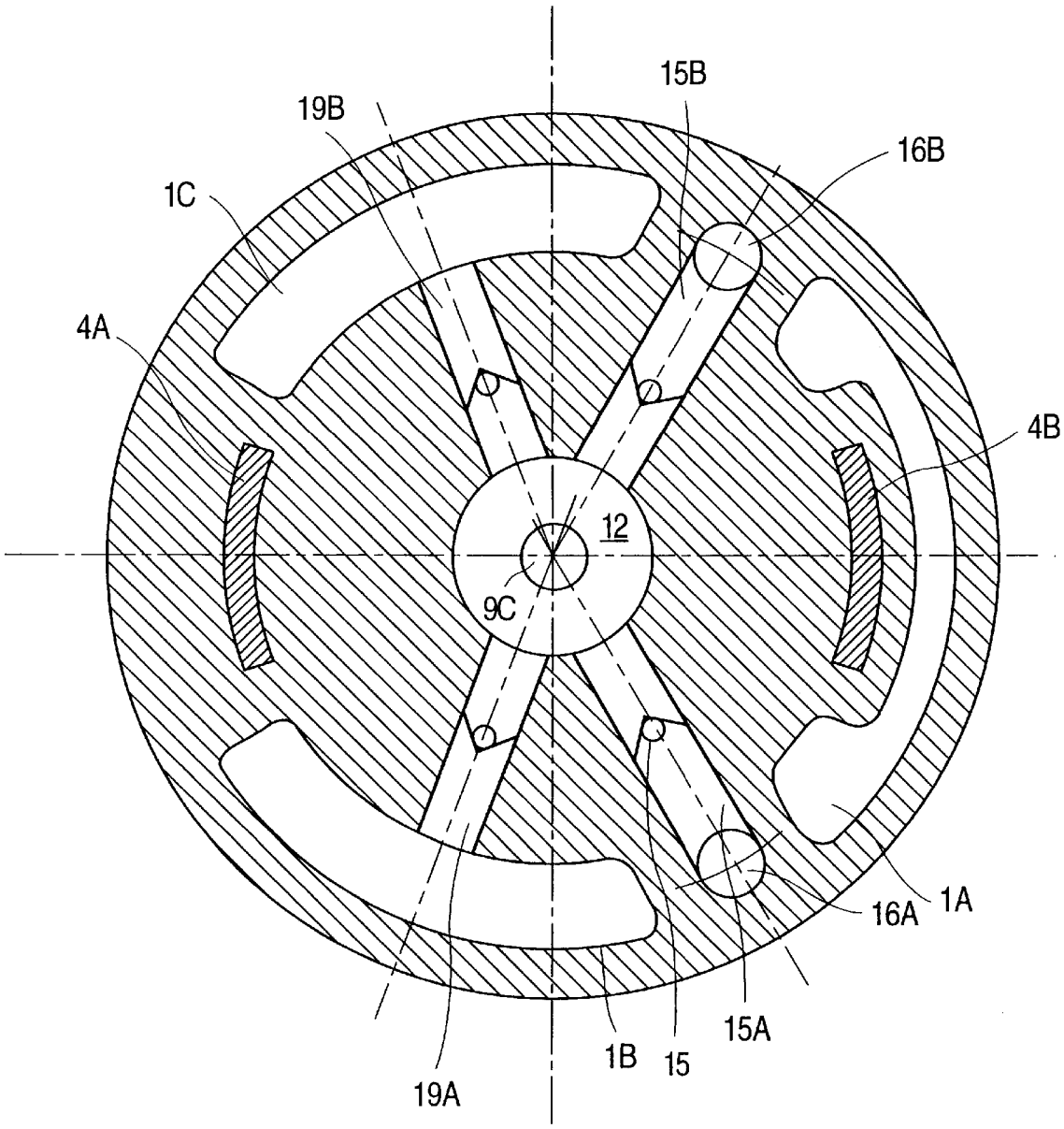
FIG. 4 shows a cross-sectional view along the line IV—IV in FIG. 1, FIGS. 5A and 5B in more detail show the design of to variants of valve bodies which can be incorporated in the structure of FIGS. 1–4, FIGS. 5C and 5D like FIGS. 5A and 5B show an additional modification of a valve body for the valve arrangement in pressure converters according to the invention.

As will be seen in particular from the cross-sectional views in FIG. 3 and FIG. 4, the two valve bodies 4A and 4B are arranged as a pair diametrically opposite one another in relation the axis of the piston. As will appear from the description below, in particular with respect to FIGS. 17 and 18, embodiments may be contemplated where there are provided more than two separate valve bodies.

Figure 5A:
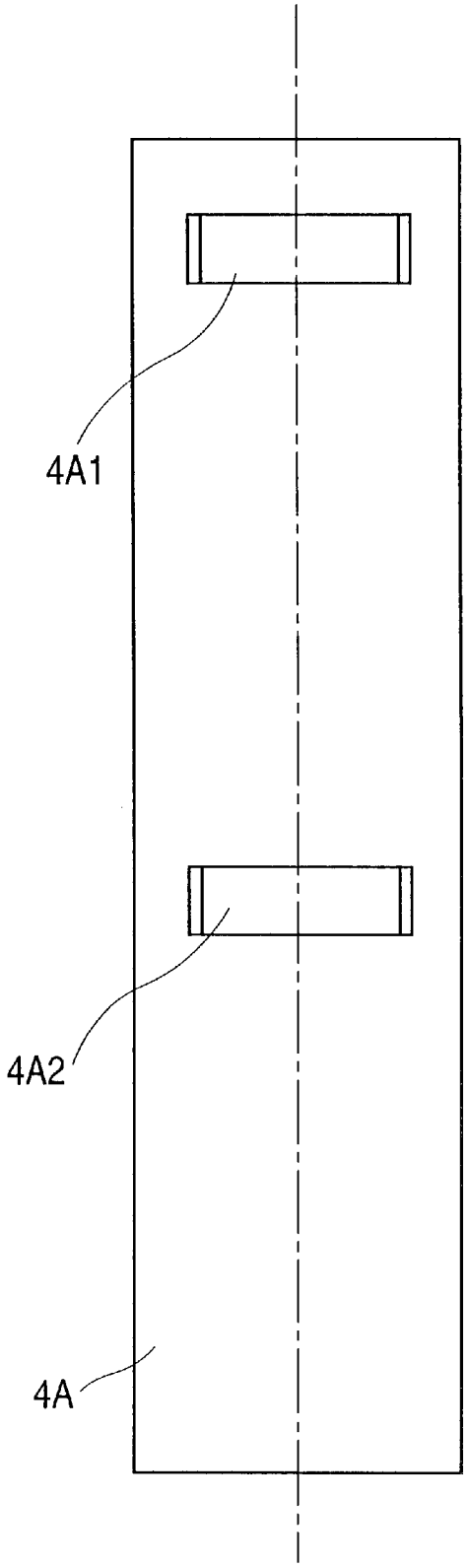
Figure 5B:
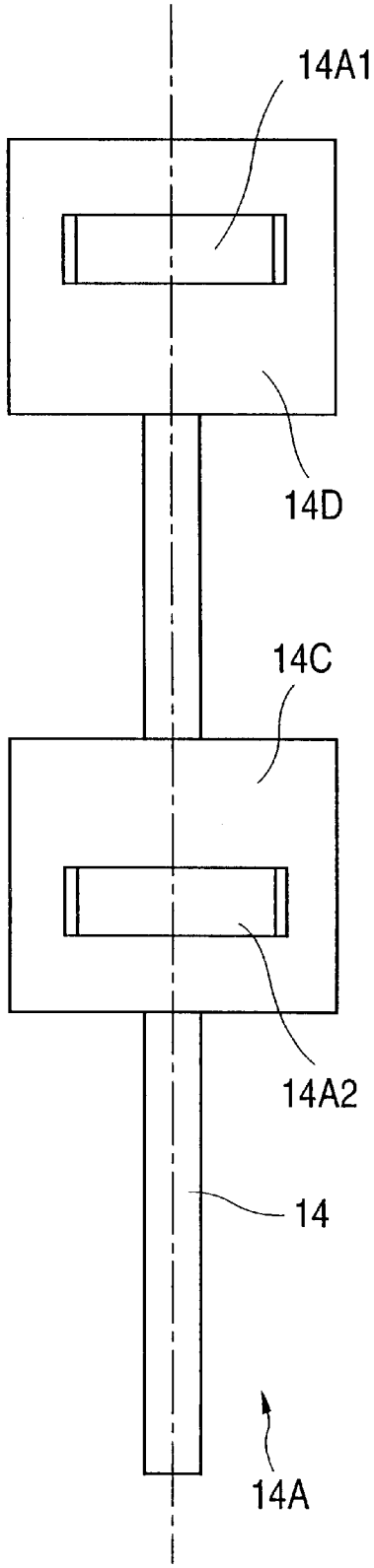

Valve body 4A in FIG. 5A is shown in elevation, whereas a corresponding elevation view in FIG. 5B shows a variant in the form of a valve body 14A comprising a central stem 14 provided with two plate-like members 14C and 14D with associated through-flow openings 14A2 and 14A1 respectively, corresponding to the opening 4A2 and 4A1 in the embodiment of FIG. 5A. The two variants are regarded as equivalent as far as the intended valve functions are concerned.

Figure 5C:
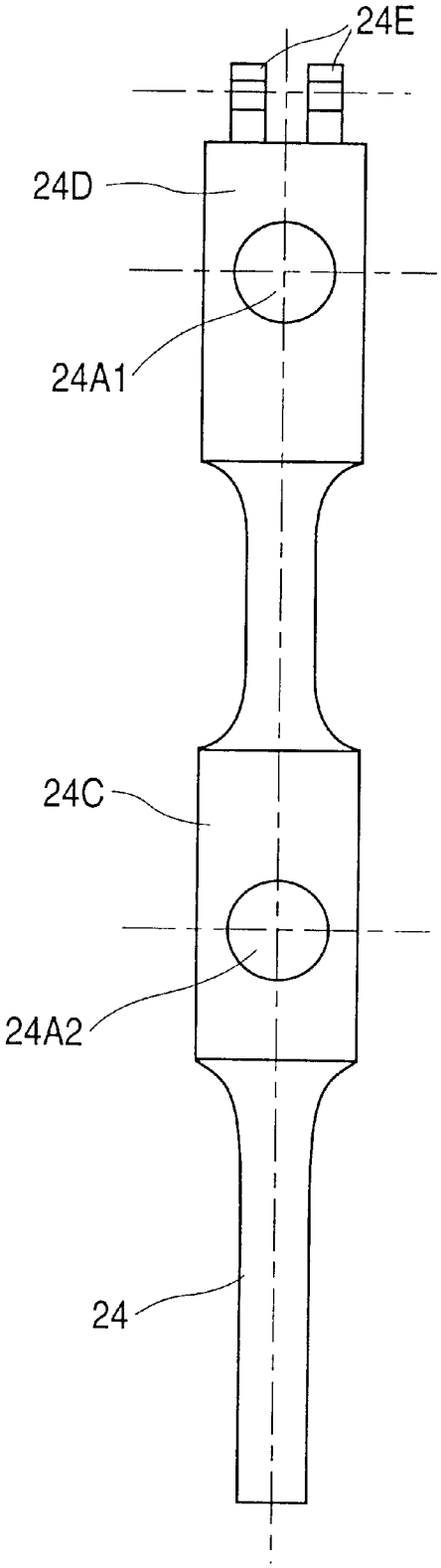
Figure 5D:
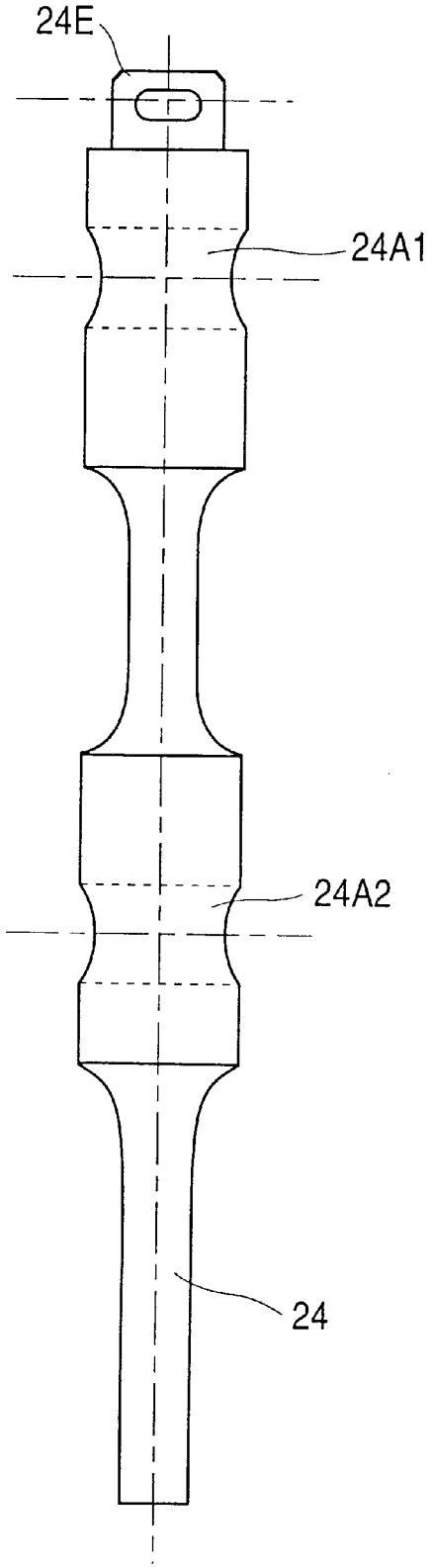

Moreover FIGS. 5C and 5D show a further modification of a valve body 24, which in contrast to the somewhat curved, plate-like shape in the preceeding figures of drawings, is based on round cross-sectional shape. As in the embodiment in FIG. 5B, the one in FIGS. 5C and 5D is based upon a stem 24 having enlarged cylindrical portions 24C and 24D with through bores 24A2 and 24A1. At the top, there are shown connection pieces 24E for co-operation with valve control elements, which can have a different design from what is discussed above with reference to FIGS. 1 and 2. The valve body in FIGS. 5C and 5D may be based on displacement in the longitudinal direction, as explained above, but it can also be based on a rotational movement (90°) between open and closed position. In the embodiment to be explained below with reference to FIGS. 19, 20 and 21, such a rotary movement of the valve bodies is of interest. Already at this point, there is here referred to valve bodies 84A and 84B in FIG. 21.

As a practical precaution it is an advantage to provide for pressure equalization in the spaces where the transfer mechanism or elements are located, as indicated with pressure equalizing passages X1 and X2 in FIG. 1.

Figure 6:
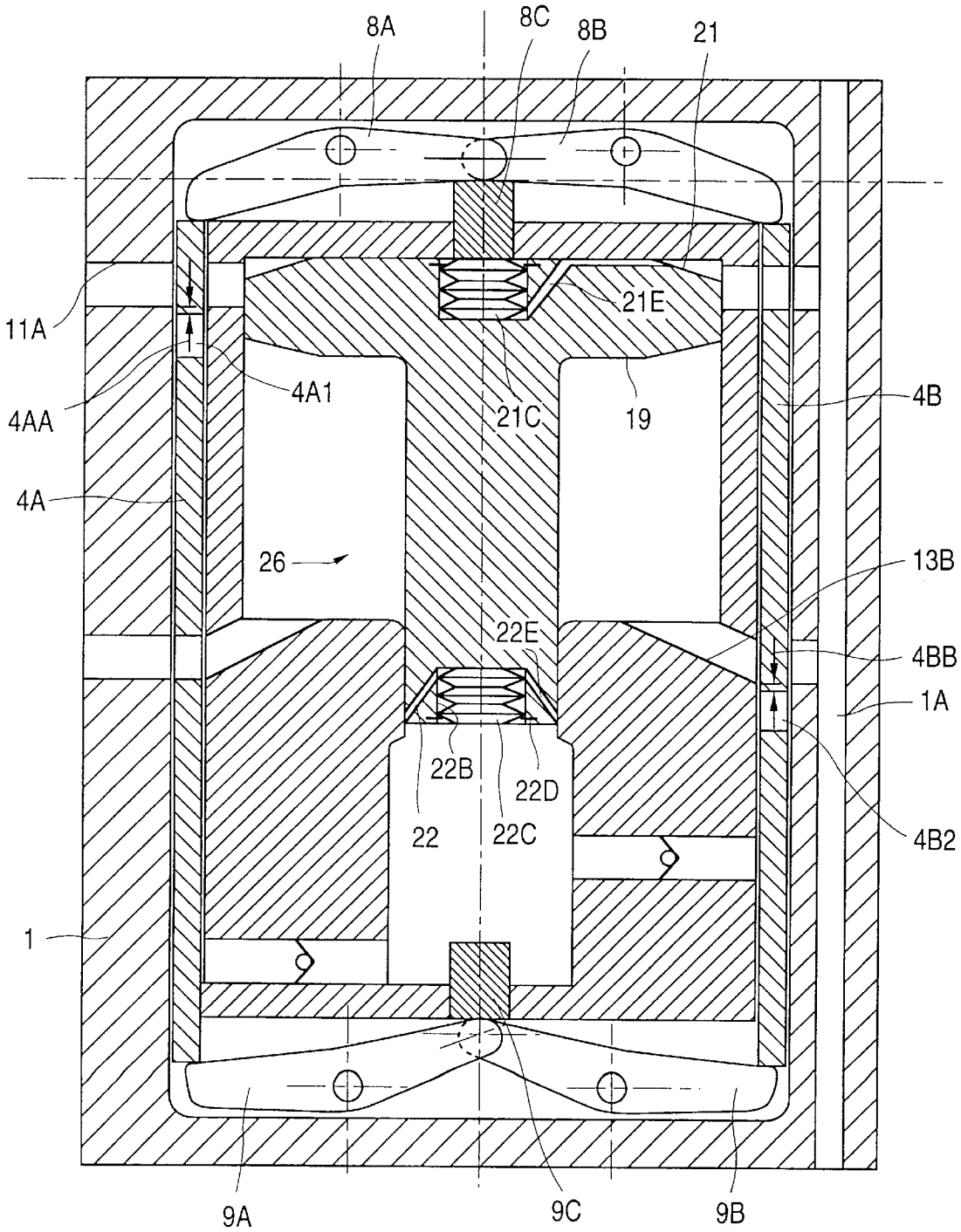
FIG. 6 shows a variant of the pressure converter according to the invention, by a similar cross-section as in FIG. 1.
Figure 7:
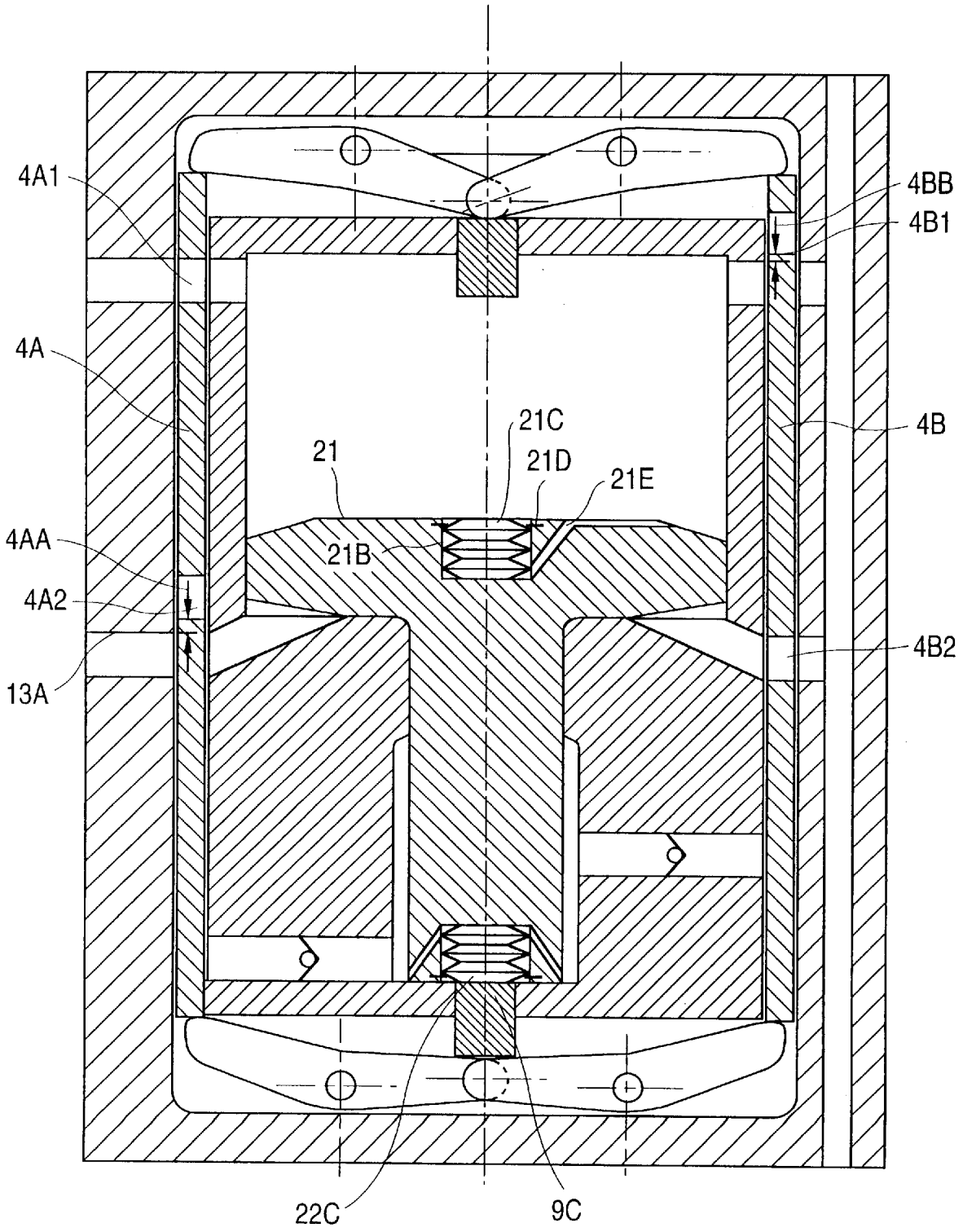
FIG. 7 shows the embodiment of FIG. 6, but with the piston in a lower end position, FIGS. 8 and 9 in partial axial section, show two positions of a braking or delaying mechanism according to a particular embodiment of the invention.

The embodiment of FIGS. 6 and 7 is quite similar to the preceeding one, but is provided with compression springs 21C and 22C mounted in recesses or bores in the respective piston areas 21 and 22. More particularly the bore for compression spring 22C is denoted 22B. Preferably cup springs are utilized and for spring 22C there is shown a retainer element 22D for maintaining the cup spring elements in bore 22B. For pressure equalization there is moreover shown a passage 22E. A corresponding passage is denoted 21E for bore 21B for compression spring 21C. These spring elements are adapted to co-operate with the plugs 8C and 9C referred to above, and primarily have the effect of cushioning or delaying the valve re-positioning at the two extreme positions of piston 26. Before the plug concerned is displaced by the piston, the associated compression spring will to some degree be compressed, so that the piston will be moved closer to the end position before the valve is reset. This ensures that piston 26 performs complete pressure strokes and return strokes between end positions, as illustrated in FIGS. 6 and 7.

Figure 8:
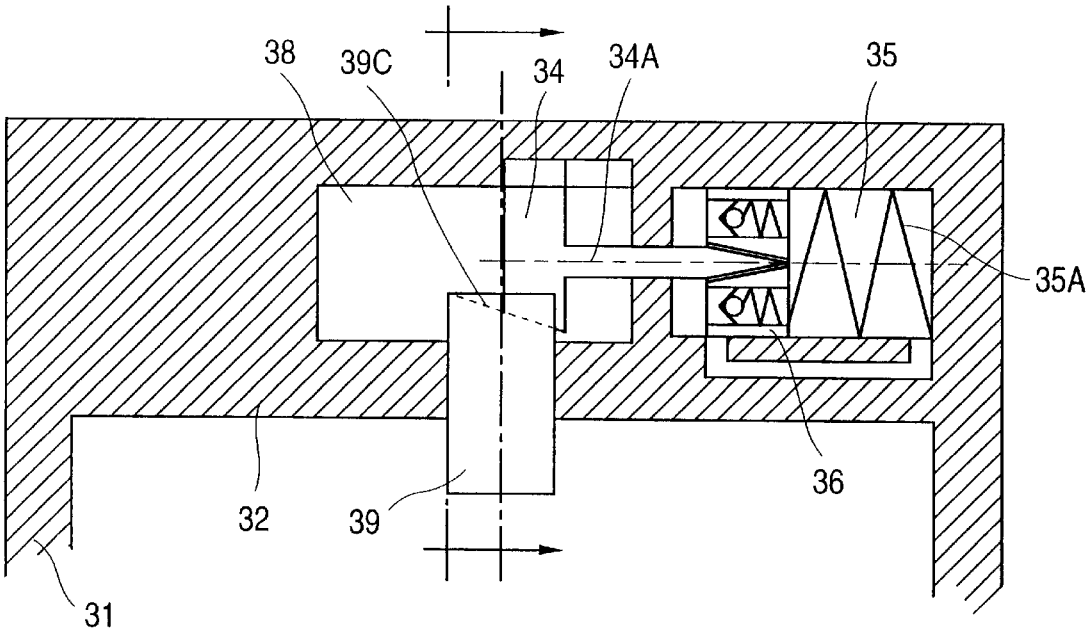
Figure 9:
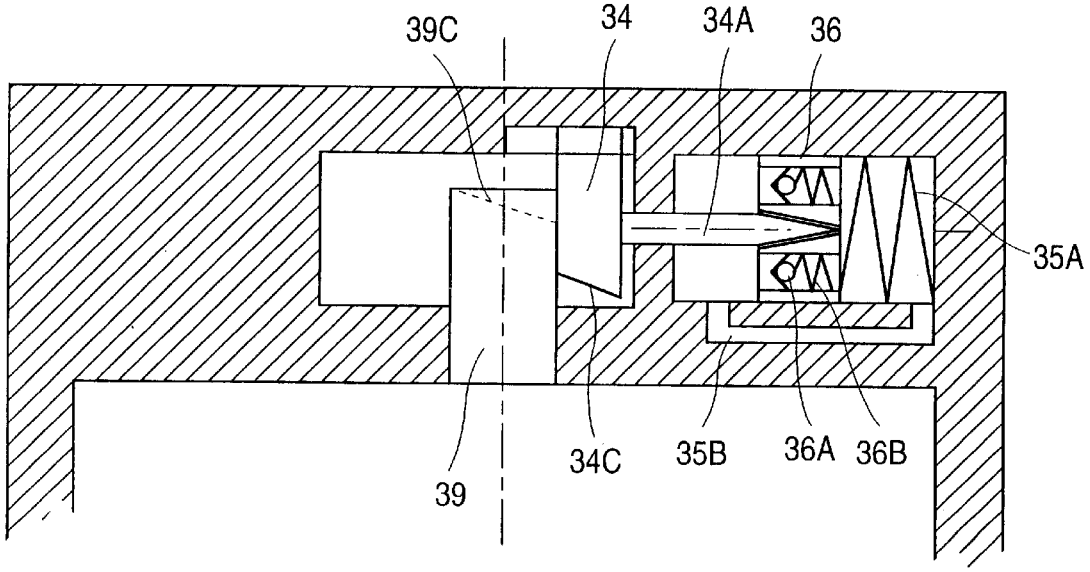
Figure 10:
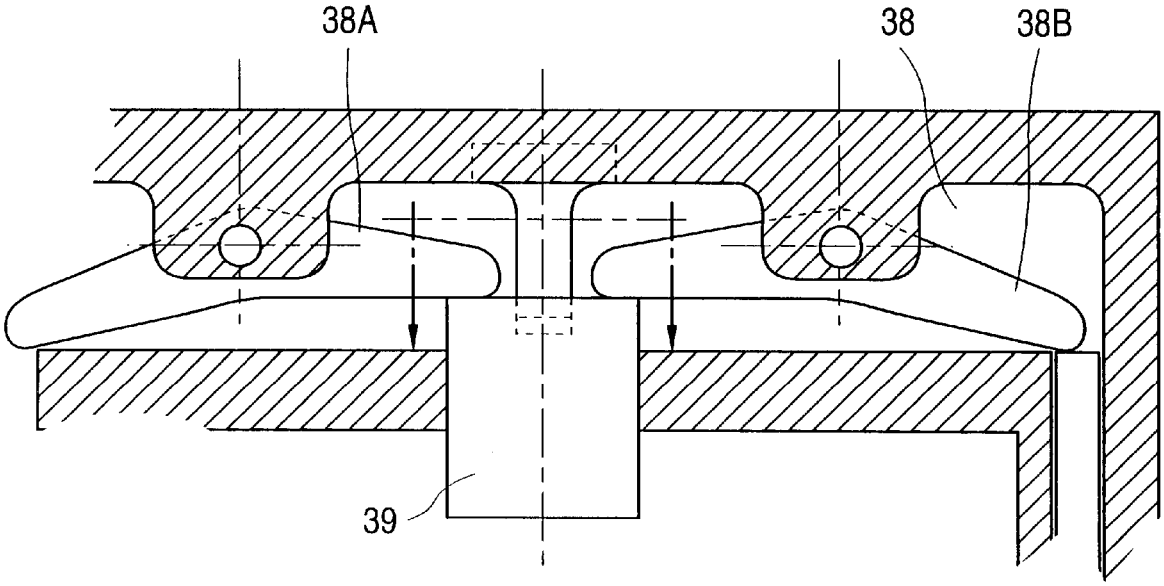
FIG. 10 shows an axial section at right angles to the sectional views in FIGS. 8 and 9.
Figure 11:
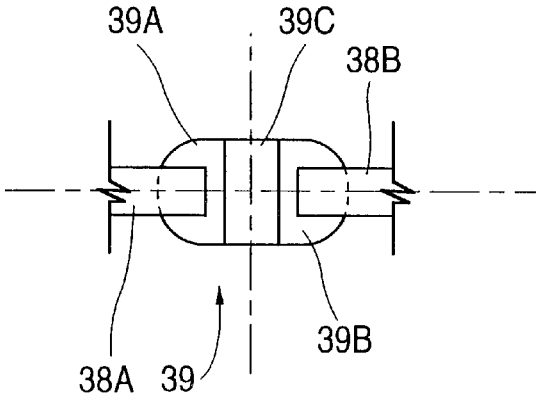
FIG. 11 shows a detail of the mechanism in FIGS. 8, 9 and 10 seen from above.

FIGS. 8–11 in detail additionally show a mechanism which can contribute to a favourable delay or braking of the valve movement. This mechanism can be combined with compression springs as explained above, or it can be used in the embodiment of FIGS. 1–4. In FIG. 8 there is shown a cylindrical housing 31 with an upper end wall 32 through which a plug element 39 is extended. Similarly to the plugs discussed above, this plug element is adapted to co-operate with the upper piston area (not shown). On top of plug element 39 there is provided an inclined surface 39C which can be located transversally and centrally over the outer end portion or the top of plug element 39, as will appear in particular from FIG. 11. At each side of the inclined surface 39C, there are abutting faces 39A and 39B for co-operation with associated rocker arms 38A and 38B.

A delay element 34 is formed with a downwardly directed inclined surface 34C (FIG. 9) adapted to co-operate with the inclined surface 39C. The element 34 further comprises a piston rod 34A with an associated piston 36 which is displaceable in a cylinder against the action of a compression spring 35A, which can consist of cup spring elements. In piston 36 there are provided check valves 36A with spring loading 36B. A bypass 35B provides for communication between the two sides of piston 36 with a suitable flow restriction. Accordingly the cylinder 35 with the piston 36 and the details described, constitute a hydraulic damper or cushioning device in co-operation with delay element 34.

From an initial position as shown in FIG. 8, delay element 34 will therefore be moved to the right when the plug element is urged upwards by the piston in the cylinder 31. This upward movement of plug element 39 accordingly will be delayed until delay element 34 releases plug 39 when the engagement between the two inclined surfaces 39C and 34C is terminated. Then the plug 39 can freely and quickly be moved to the position illustrated in FIG. 9. This quick movement may be assisted by a certain compression of optional compression springs provided in the piston area or surface concerned, for example compression springs 21C in surface 21 in FIGS. 6 and 7.

In the preceeding embodiments it is a more or less necessary requirement that the transfer mechanisms at the ends of the cylindrical housing and the valve bodies are arranged for constrained and automatic simultaneous re-positioning of the valve control elements at both ends of the housing. This however, does not necessary have to be the case, particularly in certain embodiments which make allowance for some backlash or the like. In such case it can, according to FIGS. 12 and 13 be expedient to provide return springs 41 and 45 respectively, for resetting a valve control element, i.e. 48B in FIG. 12 and valve control element or arm 49A in FIG. 13. spring 41 is located in a recess 42 in the upper end wall of the housing and co-operates with a pin 43 or the like on the rocker arm 48B concerned. A corresponding recess 46 and pin 47 are shown for spring 45 in the lower end wall of the housing.

Figure 14:
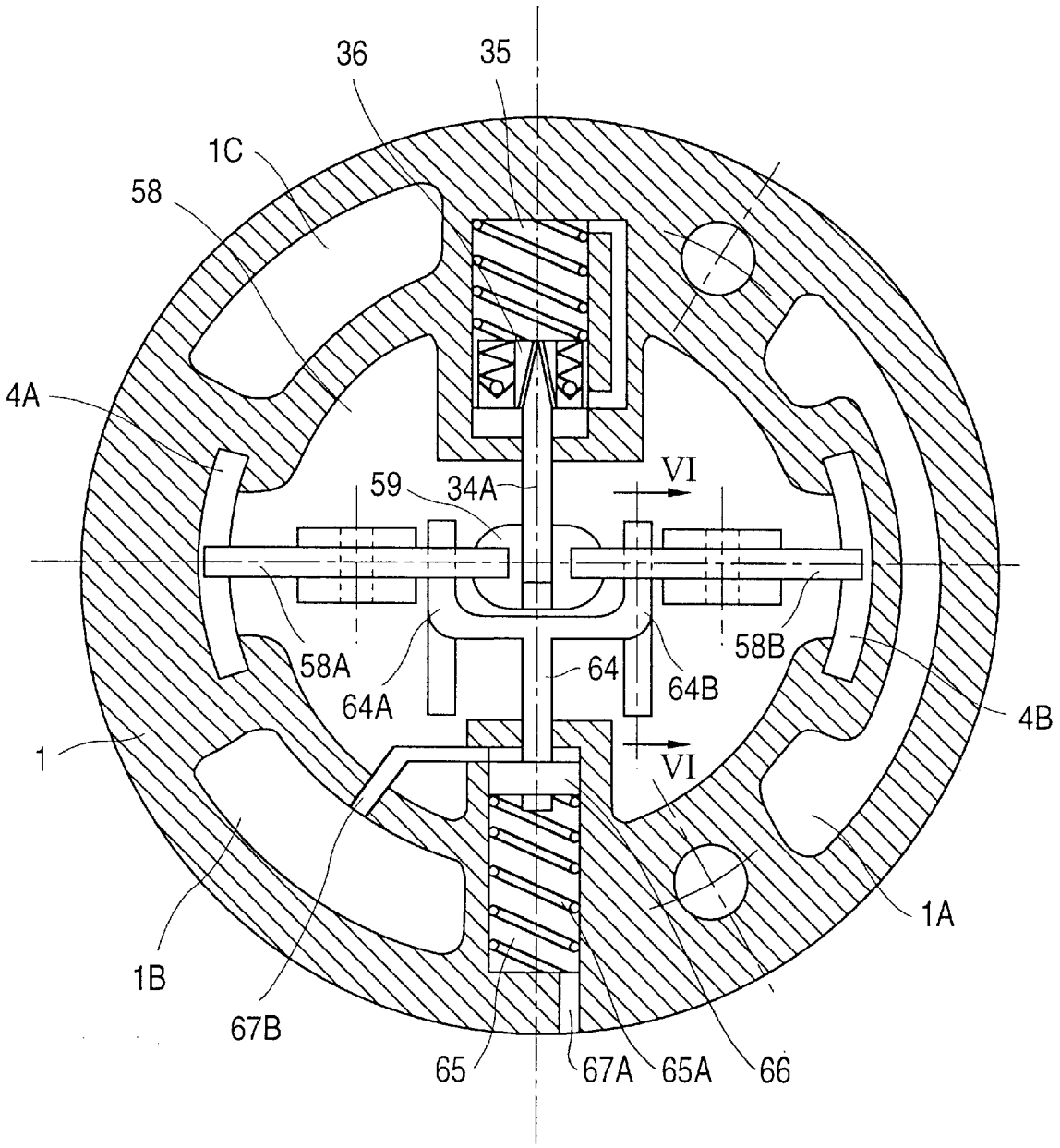
Figure 15:
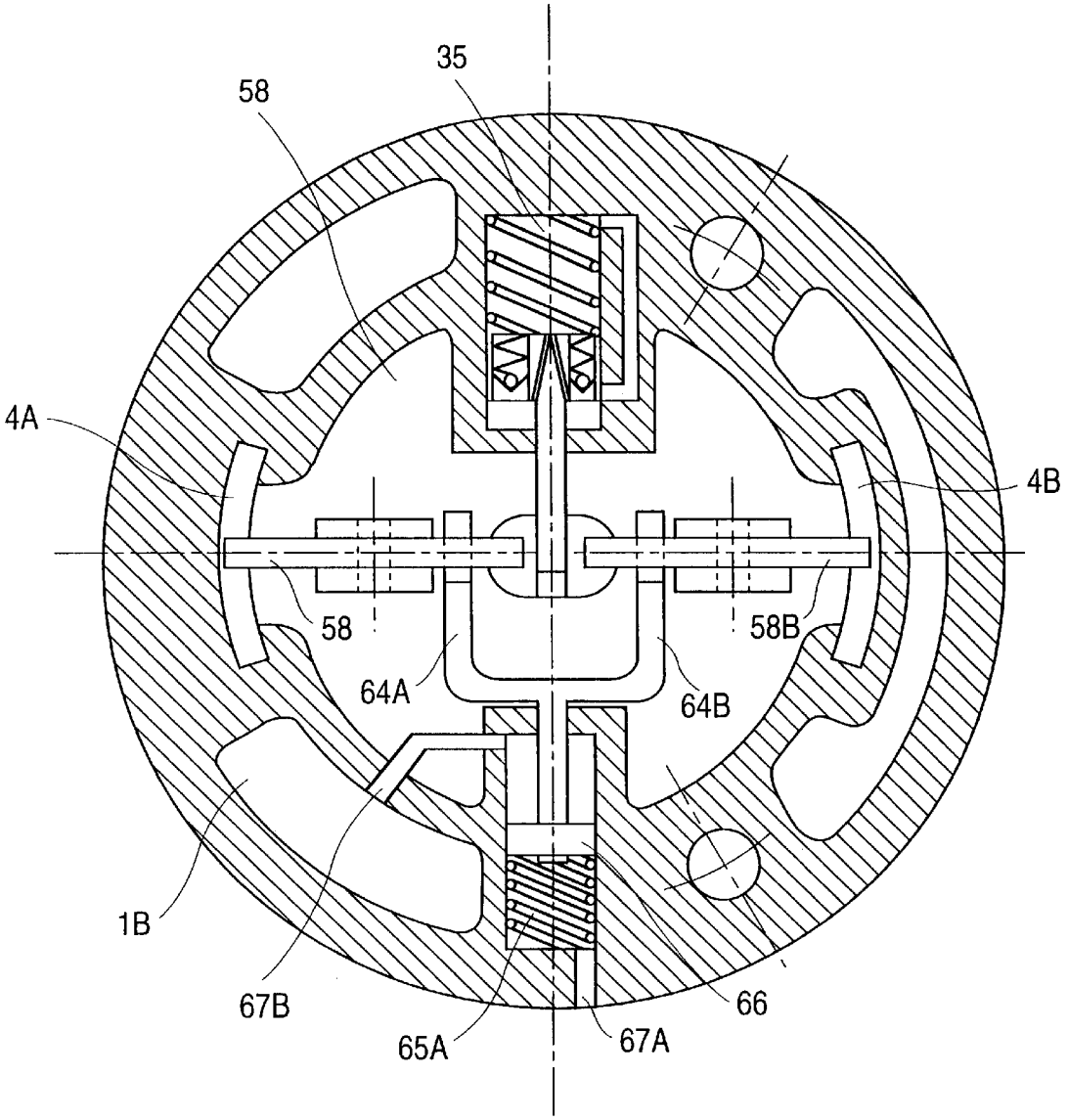
Figure 16:
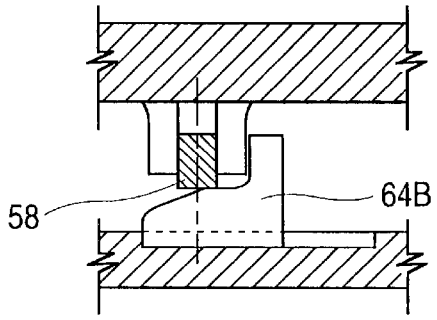

Preferably based on the embodiment with compression springs 21C and 22C as shown in FIGS. 6 and 7, the mechanism in FIGS. 8–11 is further developed or modified as shown in FIGS. 14–16. Here there is again a central and oval plug element 59 as well as a delay element with a piston rod 34A and piston 36 in the hydraulic damper cylinder 35. Valve bodies 4A and 4B correspond to those in FIGS. 1–4 and 5A or 5B. Valve control elements in the form of rocker arms 58A and 58B likewise correspond to the rocker arms in FIGS. 1–4. What is added in FIGS. 14 and 15 is a pair of wedge elements 64A and 64B having a common push rod 64. This is also a piston rod for a piston 66 being adapted to move in a cylinder 65. A compression spring 65A is provided in the cylinder. A channel 67A connects cylinder 65 to the annulus and a channel 67B connects the cylinder volume at the opposite side of piston 66, to a flow passage 1B for the supply of drilling fluid under pressure from above. In FIG. 14 there is also shown two further passages for drilling fluid supply, i.e. passage lA which is also referred to above, and passage 1C.

Figure 12:
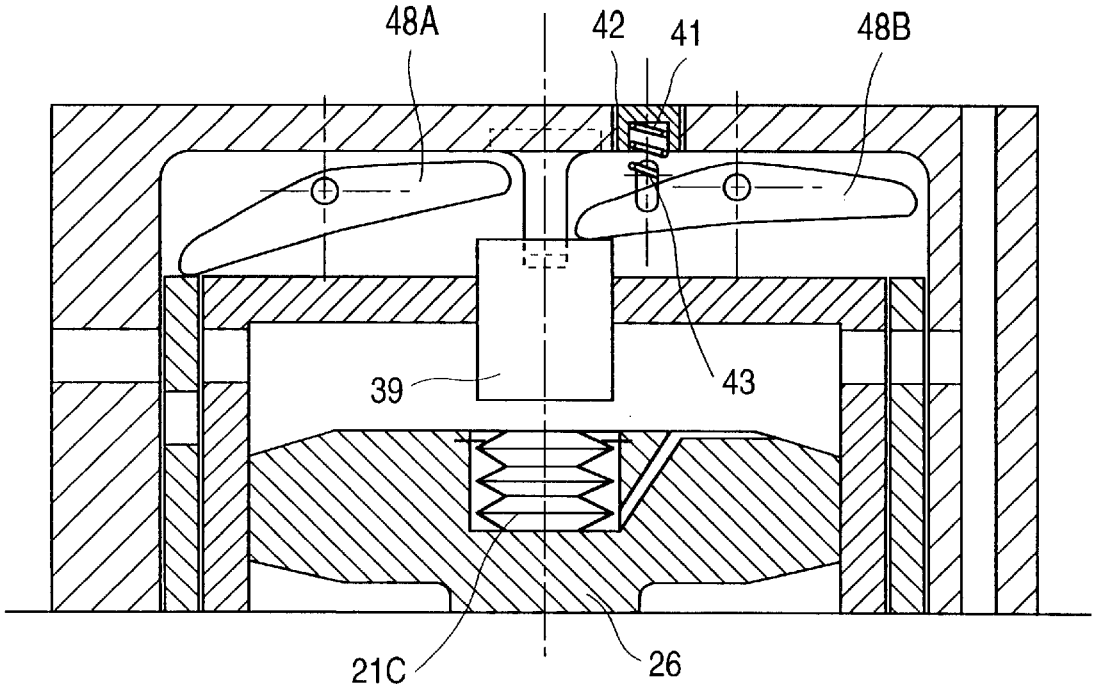
FIGS. 12 and 13 show a further embodiment having a return spring for re-setting valve control elements, FIGS. 14 and 15 in cross-sectional views show a modified or further developed variant of the mechanism in FIGS. 8–11, FIG. 16 in more detail shows a cross-section along line VI—VI in FIG. 14, FIG. 17 in longitudinal section shows a second embodiment of the pressure converter according to the invention, with the piston in an upper end position.
Figure 13:
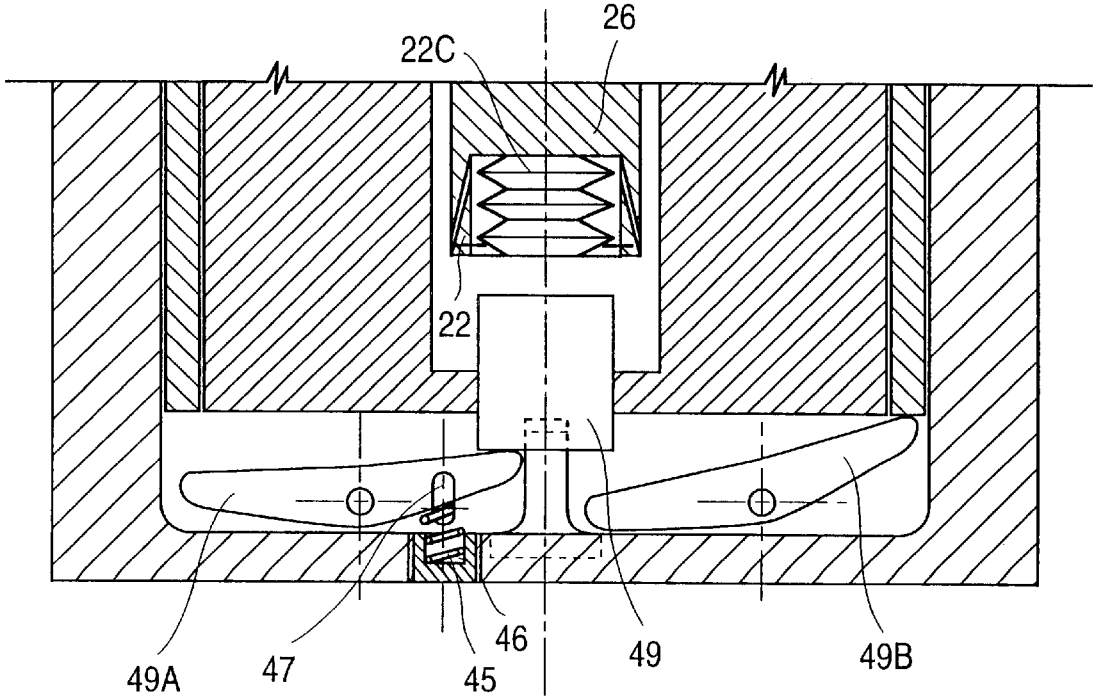

The mechanism shown here, with sedge elements 64A and 64B in the first place serves to ensure that the pressure converter as whole will be set into motion from standstill, and among other things makes it possible to delete springs 41 and 45 as discussed with reference to FIGS. 12 and 13 above.

In the position of the mechanism as shown in FIG. 14, wedge elements 64A and 64B are pushed forward and thereby lift the inner portions of rocker arms 58A and 58B as illustrated in detail with respect to arm 64B in FIG. 16. Compression spring 65A contributes to bringing the mechanism into this position. The drilling fluid pressure acts in an opposite direction through channel 67B at the upper side of piston 66, so that sufficiently high drilling fluid pressure will urge piston 66 downwards to a position as shown in FIG. 15. Thus, the wedge or lift effect on rocker arms 58A and 58B is eliminated. In this inactive position of the wedge elements, the valve arrangement and the pressure converter as a whole can be started for performing its normal function.

Figure 17:
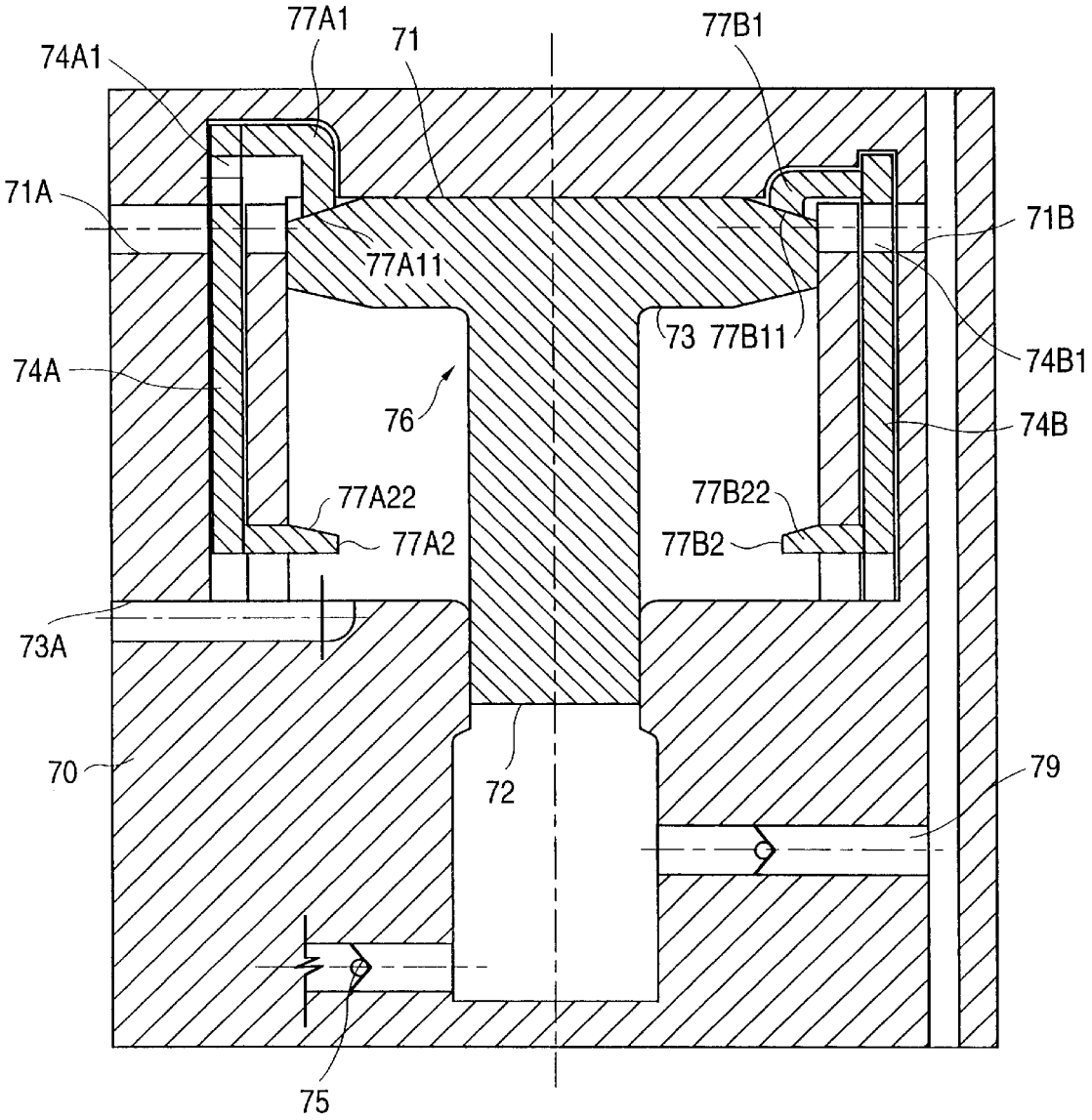
Figure 18:
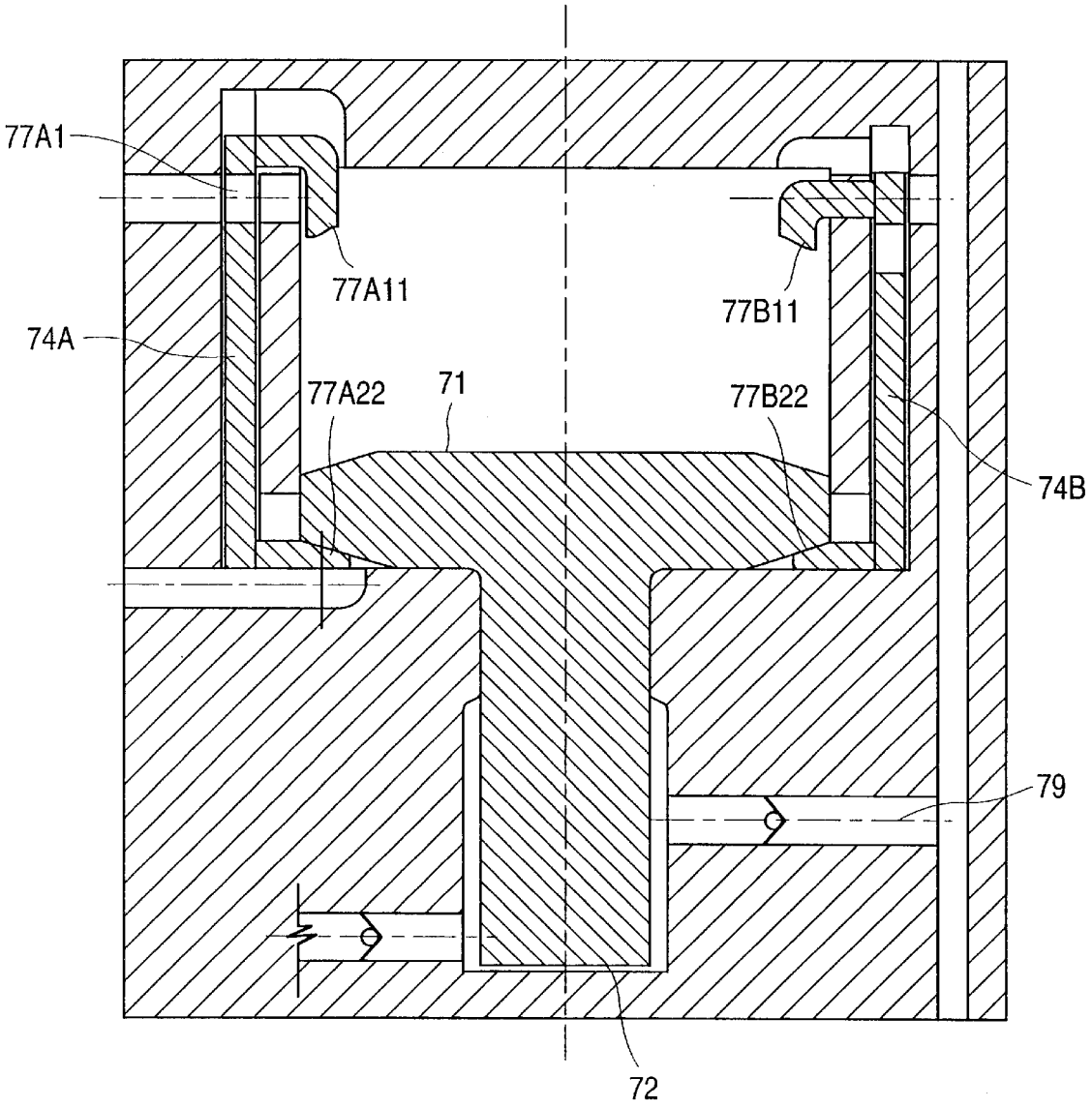
FIG. 18 shows the embodiment of FIG. 17 with the piston in a lower end position, FIG. 19 in longitudinal section shows a third embodiment of the pressure converter according to the invention, with the piston in an upper end position.

FIGS. 17 and 18 in sectional views corresponding to for example FIGS. 1 and 2, show a second embodiment of the invention, deviating from the preceeding embodiments and variants. The embodiment of FIGS. 17 and 18 among other things is simplified such that valve control elements in the form of rocker arms are not utilized. Two valve bodies 74A and 74B as shown in FIG. 17 are brought into their upper position under the influence of an upper piston area 71 on a piston 76. For this actuation of the valve bodies each of these have an upper integral valve control element 77A1 and 77B1 respectively, with downwardly facing abutting faces 77A11 and 77B11 respectively as illustrated. At the opposite or lower end the valve bodies also have integral valve control elements 77A2 and 77B2 respectively, with associated abetting faces 77A22 and 77B22 adapted to be contacted by the downwardly facing piston surface 73 in the lower piston position. This position is shown in FIG. 18.

As in the preceeding embodiments valve bodies 74A and 74B are adapted to control drilling fluid flows in and out in relation to the low pressure side, i.e. the space in front of piston area 71 on piston 74. This takes place through an inlet 71B and valve openings 74B1 as well as an outlet 71A and a valve opening 74A1, the latter opening being closed in FIG. 17 but is open in FIG. 18. A passage 73A (FIG. 17) is open to the annulus at all times, for free "breathing" of the space in front of piston area 73. Advantageously in this space there can be provided a return spring for assisting in bringing piston 76 from the bottom position in FIG. 18 to the upper position in FIG. 17, i.e. the return stroke of the piston.

The generally axially and oppositely facing engagement or abutting faces 77A11, 77A22, 77B11, 77B22 on the radially inwardly projecting valve control elements 77A1, 77A2, 77B1 and 77B2 have a mutual spacing in axial direction being smaller than the piston stroke, in order that the intended re-positioning movement under direct actuation from the piston areas or surfaces 71 and 73 shall take place.

It is obvious that in this simplified second embodiment according to the invention, also further modifications can be made, possibly such that the number of movable elements will be reduced to a minimum. This for example could be done by having a common, diametrically running yoke between the tops the valve bodies, and preferably at the central portion of the yoke an axially downwards projecting pluglike element adapted to be contacted by the upper piston surface 71. As another alternative the principle of FIGS. 17 and 18 can make possible designs with more than two valve bodies 74A and 74B, such as an arrangement with several sets of opposed pairs of valve bodies.

The high pressure side of the piston is denoted 72 and associated check valves are shown at 75 and 79 respectively, for discharging drilling fluid under high pressure, and for in-flow of drilling fluid to be subjected to pressure increase.

Figure 19:
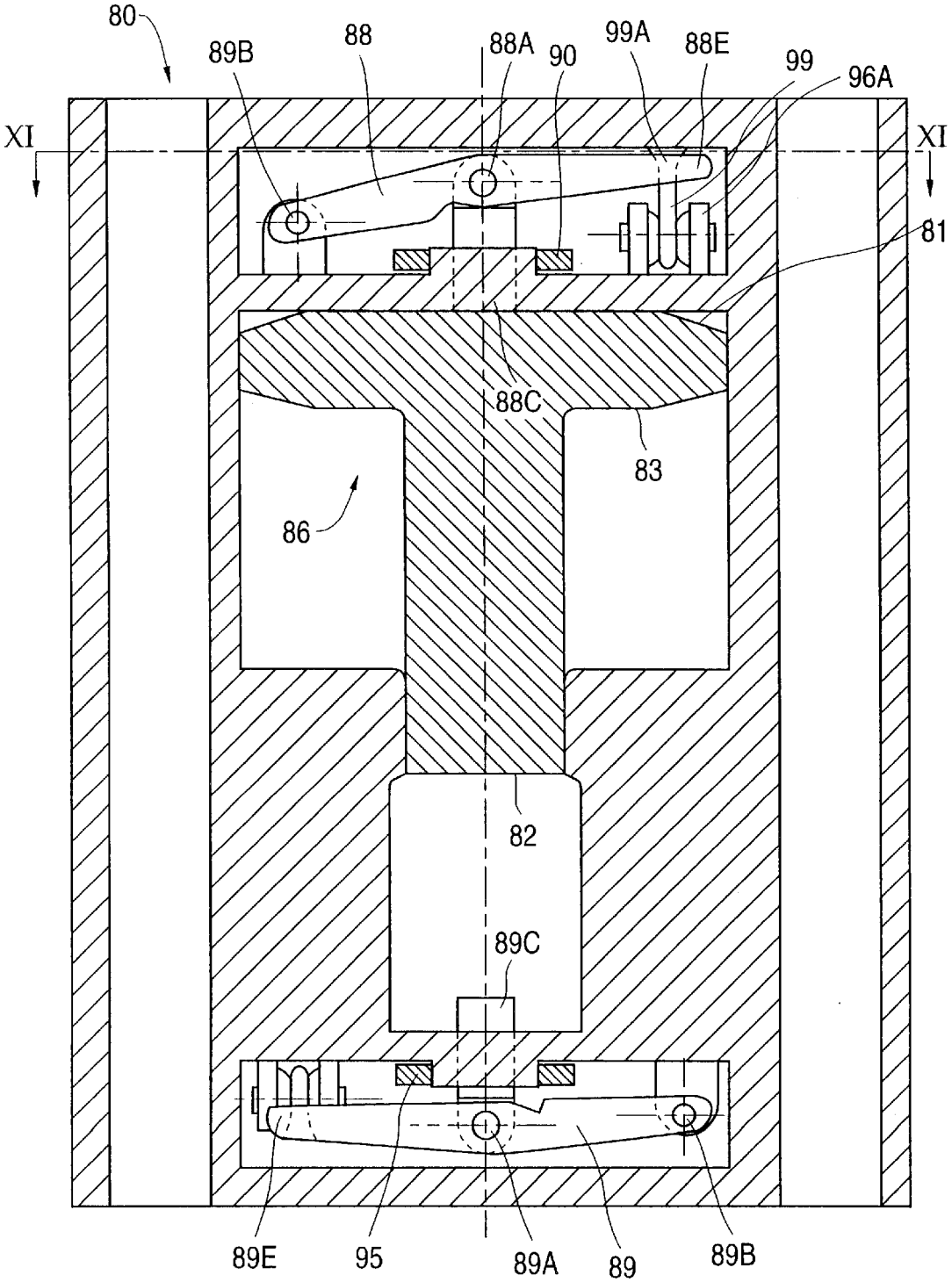
Figure 20:
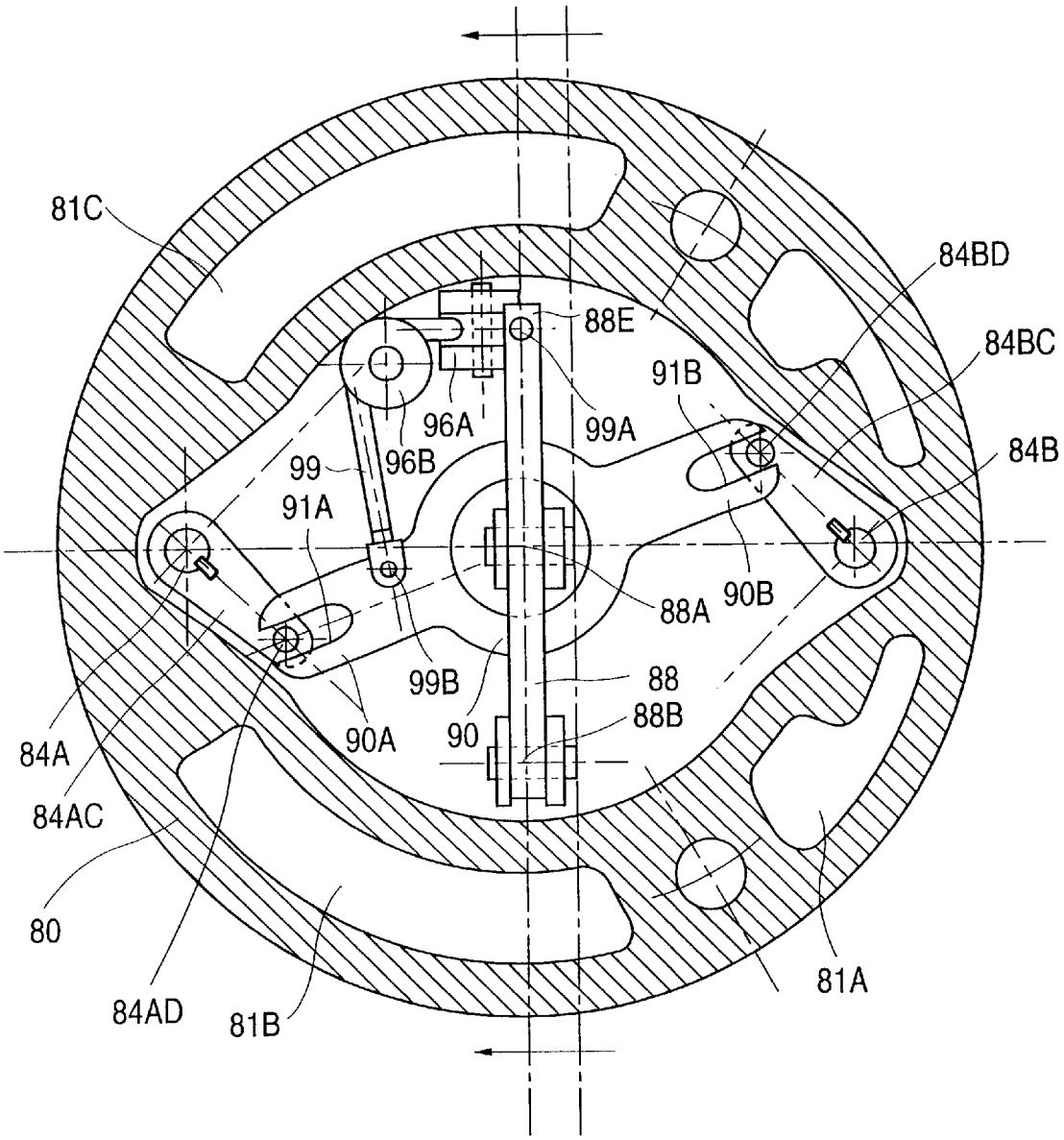
FIG. 20 shows a cross-sectional view along line XI—XI in FIG. 19.
Figure 21:
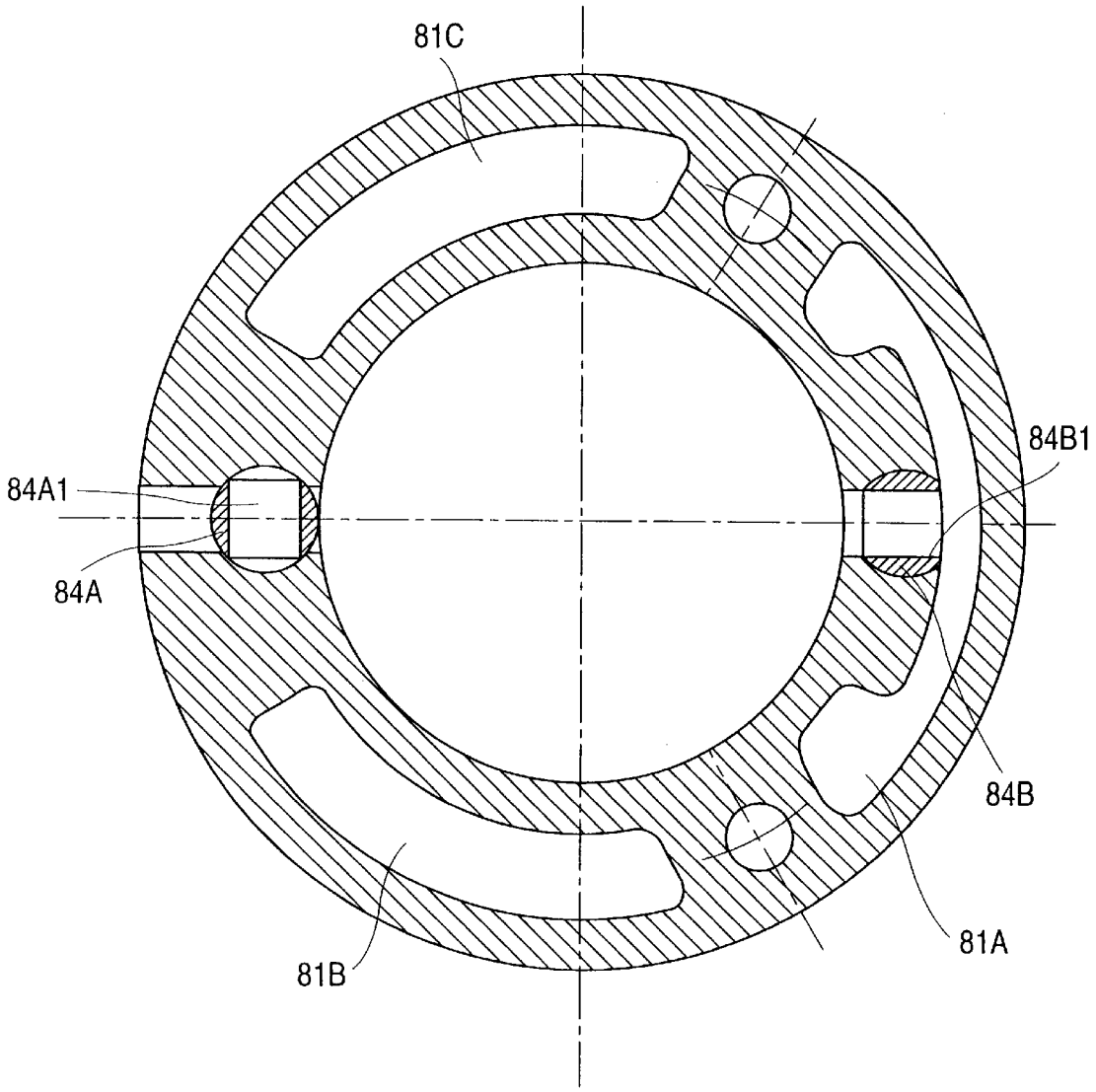
FIG. 21 shows another cross-sectional view for illustration of rotatable valve bodies in the embodiment of FIGS. 19 and 20.

A third embodiment of the invention is illustrated in FIGS. 19–21. The pressure converter 80 shown therein like the preceeding embodiments has a piston 86 with an upper piston area 81, a lower piston area 83 and a smaller piston area 82 on the high pressure side. In the cross sectional views of FIGS. 20 and 21, there are again incorporated longitudinal flow passages 81A, 81B and 81C for the supply of drilling fluid under pressure from above. Rotatable valve bodies 84A and 84B are shown in FIG. 21, whereby valve body 84B is shown therein in an open position, i.e. for the supply of drilling fluid pressure through the through-flow opening 84B1 in the valve body, whereas the opening 84A1 in valve body 84A has been rotated 90° to a closed position.

With a transfer mechanism or valve control elements as illustrated in FIGS. 19 and 20, this rotary movement of valve bodies 84A and 84B is provided for by converting a displacement or translatory movement of a plug element 88C, to rotary movement of the valve bodies. In the mechanism there is more particularly incorporated a rocker arm 88 (at the top of FIG. 19) which is pivotable at 88B and has a pivot connection at 88A to the top of plug element 88C. At the outer (right hand) end 88E of arm 88, there is attached a flexible pull element 99, which can for example consist of a relatively thin steel wire. This runs via two pullies 96A and 96B to an attachment point 99B at the other end of the element. Attachment point 99B is located on a swing arm 90 being adapted to perform angular movements about an axis parallel to or preferably coincident with the central axis through the pressure converter 80. The swing arm 90 at its outer ends 90A and 90B respectively, has slits 91A and 91B being in engagement with pins 84AD and 84BD carried by levers 84AC and 84BC respectively, being keyed to the top of the rotatable valve bodies 84A and 84B. The arm-lever mechanism described here with axes in parallel to the longitudinal axes of the valve bodies and the pressure converter, during upward or downward movement of plug element 88C will lead to rotary movements of valve bodies 84A and 84B, whereby the geometrical relationships are so chosen that the angle of rotation of the valve bodies preferably will be 90°. As mentioned previously, these valve bodies can have a design as shown in FIGS. 5C and 5D.

For completeness, attention is also drawn to the valve control elements in the lower part of the pressure converter in FIG. 19, i.e. comprising plug element 89C, an arm 89 having pivot connections at 89A and 89B as well as an outer end 89E with attachments for a wire (not shown). Moreover there is also here incorporated an arm mechanism corresponding to what is discussed above with reference to FIG. 20. It will be seen that the mechanism at the upper side of piston 86 serves to rotate valve bodies 84A and 84B in one direction, whereas the lower mechanism serves to rotate the valve bodies back in the opposite direction.

Although this third embodiment in FIGS. 19–21 contains relatively many movable parts, it may constitute an advantageous alternative in certain fields of use.

Figure 22:
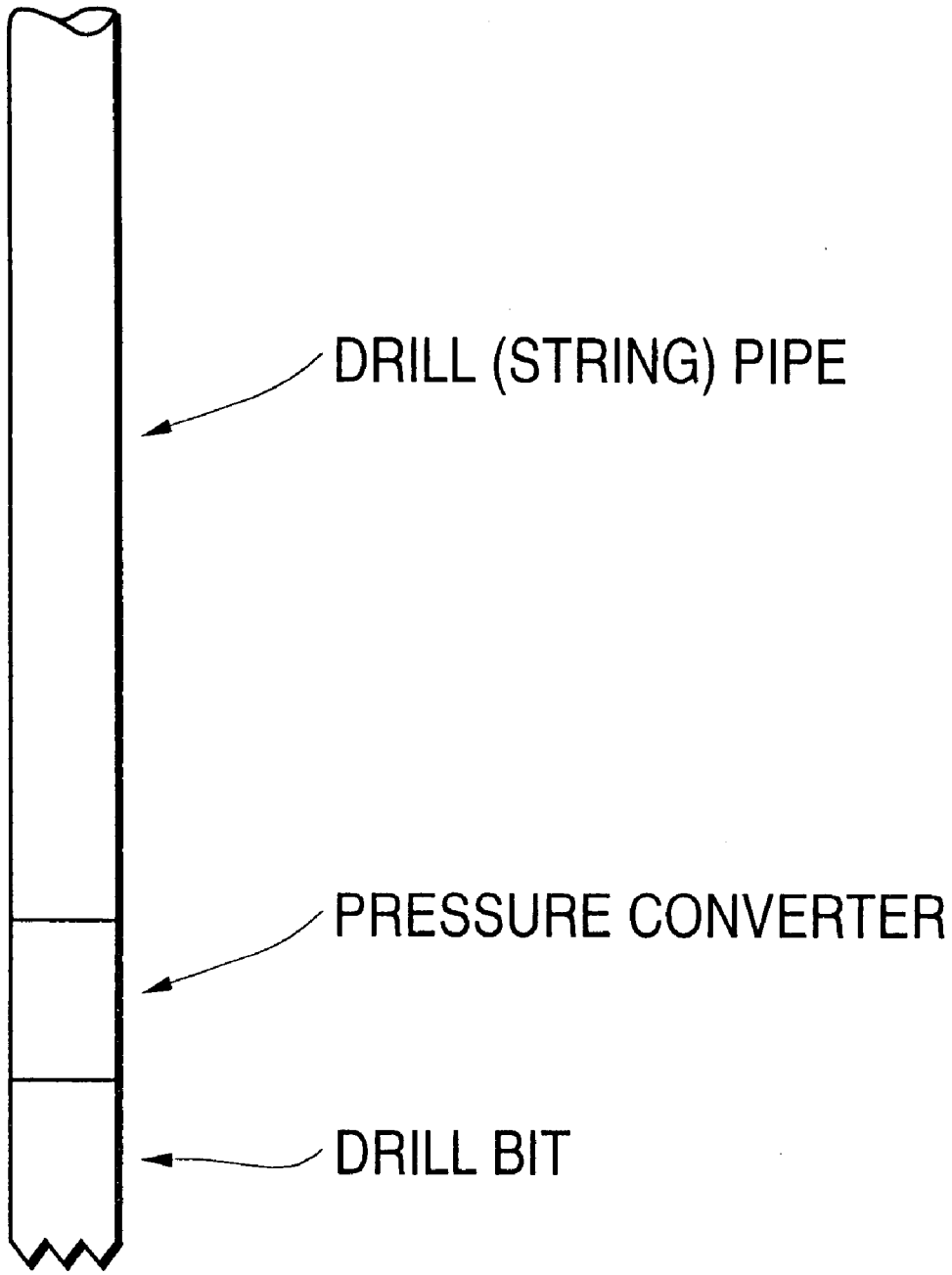
FIG. 22 shows a pressure converter according to the present invention mounted at the lower end of a drill pipe above a drill bit.

The pressure converter according to the present invention is shown in FIG. 22 mounted at the lower end of the drill pipe, above the drill bit.

The solutions being here described with reference to the drawings, can also be utilized in some of the specific variants shown in the above mentioned Norwegian Patent Specifications, perhaps in particular the outlet channel according to Norwegian Patent 171.325 and the interconnection as a pressure converter group according to Norwegian Patent 171.325.

What is claimed is:

1. A pressure converter for mounting above a drill bit at the lower end of a drill pipe for generating an increased fluid pressure by utilizing energy in a drilling fluid flow down through the drill pipe, comprising:

a reciprocating piston, having a pressure stroke and a return stroke between opposite end positions in a cylinder, and having a first side with a relatively large piston area which during the pressure stroke is subjected to the drilling fluid pressure in the drill pipe, and a second side with a first opposite piston area and a second opposite and relatively small piston area which during the pressure stroke generates an increased pressure in a smaller portion of the drilling fluid flow, valve means having at least one valve body for controlling drilling fluid flows to and from the piston, a channel for connecting a space in front of the first opposite piston area to an annular space outside the drill pipe at least during the return stroke, a second channel with a check valve connecting a space in front of the second opposite piston area to a high pressure channel leading forward to the drill bit, and at least one further channel which is adapted to connect a space in front of the relatively large piston area to the annular space outside the drill pipe during the return stroke, wherein for each end position of the piston there is provided at least one movable valve control element being adapted to be moved by the reciprocating piston at either end position, and each valve control element is adapted to actuate at least one valve body in the valve means, which is adapted to be re-positioned upon movement of the respective valve control element for control of drilling fluid flows during the pressure stroke and the return stroke.

2. Pressure converter according to claim 1 wherein each valve body has a length extension in parallel to the axial direction of the piston, at least corresponding to the stroke of the piston.

3. Pressure converter according to claim 2 wherein at least two separate valve bodies are located in a wall of the cylinder diametrically opposite to one another in relation the axis of the piston.

4. Pressure converter according to claim 3 wherein the at least one valve control element comprises a plug element being adapted to project axially into the cylinder and to be actuated by the piston in order to bring about said movements of at least one valve control element.

5. Pressure converter according to claim 4 wherein at least one valve control element comprises at least one rocker arm co-operating with at least one plug element, whereby an inner free end of the at least one rocker arm is adapted to engage an outer end surface of the at least one plug element and an outer free end of the at least one rocker arm is adapted to move an associated valve body.

6. Pressure converter according to claim 5 wherein at least one of the piston areas engaging the plug elements is provided with a compression spring for co-operation with the associated plug element.

7. Pressure converter according to claim 6 wherein the compression springs are in the form of cup spring elements being located in bores in the piston areas.

8. Pressure converter according to claim 6 wherein an outer end portion of at least one plug element via an inclined surface co-operates with a radially displaceable and spring loaded delay element in order to compress one of the compression springs before the piston area engages the plug element for moving at least one valve control element.

9. Pressure converter according to claim 8 wherein the inclined surface comprises a central portion on the outer end portion of the plug element, and the outer end portion at each side of the central inclined surface portion has abutting faces for the rocker arms.

10. Pressure converter according to claim 6 wherein at least one valve control element is provided with a return spring for resetting the at least one valve control element and the associated plug element when the piston leaves the corresponding end position.

11. Pressure converter according to claim 6 wherein an inner portion of each rocker arm is adapted to co-operate with wedge elements being connected to a cylinder device with a piston element for moving the wedge elements transversally of the rocker arms one side of the piston element in the cylinder device communicating with the annular space and being spring loaded for resetting the rocker arms, and the other side of the piston element being adapted to move the wedge elements to an inactive position in relation to the rocker arms upon supply of drilling fluid pressure.

12. Pressure converter according to claim 2 wherein each valve body is coupled to a co-operating valve control element at least at one of its ends.

13. Pressure converter according to claim 2 wherein each valve body is adapted to be displaced in its longitudinal direction between end positions corresponding to the pressure stroke and the return stroke, respectively.

14. Pressure converter according to claim 1 wherein the valve control element comprises:

a rocker arm for co-operation with an associated plug element;

at least one flexible pull element, having one end connected to the rocker arm and the other end connected to a lever mechanism having an articulation axis being parallel to the axis of at least one valve body; and at least one pulley for guiding each pull element, in order to convert the translatory movement of the plug element to rotary movement of an associated valve body.

15. Pressure converter according to claim 1 wherein each valve body is provided with radially projecting valve control elements being formed as generally axial abutting faces facing oppositely and having a spacing being smaller than the stroke of the piston and being adapted to directly co-operate with two of the piston areas of the piston.

* * * * *